US011998113B2

(12) United States Patent
Battilana et al.

(10) Patent No.: US 11,998,113 B2
(45) Date of Patent: Jun. 4, 2024

(54) SHEET FOR THE ASSEMBLY OF A DISPLAY SHELVING UNIT AND THE DISPLAY SHELVING THUS OBTAINED

(71) Applicants: Pablo Battilana, Buenos Aires (AR); Mariano Colombo, Buenos Aires (AR)

(72) Inventors: Pablo Battilana, Buenos Aires (AR); Mariano Colombo, Buenos Aires (AR)

( * ) Notice: Subject to any disclaimer, the term of this patent is extended or adjusted under 35 U.S.C. 154(b) by 0 days.

(21) Appl. No.: 17/904,263

(22) PCT Filed: Oct. 21, 2020

(86) PCT No.: PCT/EP2020/079656

§ 371 (c)(1),
(2) Date: Aug. 15, 2022

(87) PCT Pub. No.: WO2021/164902

PCT Pub. Date: Aug. 26, 2021

(65) Prior Publication Data

US 2023/0090599 A1 Mar. 23, 2023

(30) Foreign Application Priority Data

Feb. 17, 2020 (AR) ..... P20200100442

(51) Int. Cl.

| | |
|---|---|
| ***A47B 47/02*** | (2006.01) |
| ***A47B 55/00*** | (2006.01) |
| ***A47F 5/10*** | (2006.01) |

(52) U.S. Cl.

CPC ..... *A47B 47/025* (2013.01); *A47B 47/02* (2013.01); *A47B 47/024* (2013.01); *A47B 55/00* (2013.01); *A47F 5/10* (2013.01)

(58) Field of Classification Search

CPC ..... A47B 47/025; A47B 47/024; A47B 47/02; A47B 47/06; A47B 43/00; A47B 47/021;

(Continued)

(56) References Cited

U.S. PATENT DOCUMENTS 1,497,456 A * 6/1924 List ..... A47F 5/112 211/72
1,720,136 A * 7/1929 Neumann ..... A47F 5/112 211/73

(Continued)

FOREIGN PATENT DOCUMENTS

CN 2558285 Y 7/2003
CN 2845594 Y 12/2006

(Continued)

OTHER PUBLICATIONS

Search Report in corresponding International Patent Application No. PCT/EP2020/079656, mailed Feb. 10, 2021, in 4 pages.

(Continued)

*Primary Examiner* — Jennifer E. Novosad
(74) *Attorney, Agent, or Firm* — Knobbe, Martens, Olson & Bear, LLP

(57) ABSTRACT

A sheet for the assembly of a display shelving unit and the display shelving unit thus obtained, which, thanks to its structural simplicity can be assembled and disassembled for recycling in a practical, fast and easy way, since it is made of recycled materials which require fewer manufacturing processes, and which, because of its small volume, allows for the transportation of a larger number of units in the same shipment, thus significantly reducing the related costs.

11 Claims, 20 Drawing Sheets

(58) Field of Classification Search
CPC ..... A47B 55/00; A47F 5/112; A47F 5/114; A47F 5/116; A47F 5/118
USPC ..... 211/135, 72, 73
See application file for complete search history.

(56) References Cited

U.S. PATENT DOCUMENTS 1,997,310 A * 4/1935 Roege ..... G09F 5/00 211/72
2,256,339 A * 9/1941 Fallert ..... G09F 5/02 312/351
2,324,232 A * 7/1943 Pantalone ..... A47F 5/112 211/73
2,391,285 A * 12/1945 Marshall ..... A47F 5/112 D6/310
2,677,469 A * 5/1954 Ludwig ..... A47F 5/112 248/459
2,833,457 A * 5/1958 Tyrseck ..... B65D 5/524 229/164
2,918,178 A * 12/1959 Leone ..... A47F 5/116 211/195
2,990,056 A * 6/1961 Gillam ..... B65D 5/5038 206/732
3,987,892 A * 10/1976 Killy ..... B65D 5/5023 206/443
4,311,100 A * 1/1982 Gardner ..... A47F 5/116 108/165
4,493,424 A * 1/1985 Smith ..... A47F 5/116 108/165
4,618,115 A * 10/1986 Belokin, Jr. ..... A47F 5/116 248/174
4,630,740 A * 12/1986 Belokin, Jr. ..... A47F 5/116 248/174
5,141,115 A * 8/1992 Nicoll ..... A47F 7/147 211/88.01
5,190,211 A * 3/1993 Stoddard ..... A47F 5/116 229/120.21
5,213,220 A * 5/1993 McBride ..... A47B 55/06 211/132.1
5,301,800 A * 4/1994 Kenney ..... A47F 7/147 206/45.25
5,499,711 A * 3/1996 Kozak ..... B65D 5/5038 206/45.24
5,522,574 A * 6/1996 Maglione ..... A47F 5/112 248/220.31
5,669,683 A * 9/1997 Moss ..... A47B 47/06 312/259
5,678,492 A * 10/1997 Pinkstone ..... A47B 43/02 108/165
5,722,628 A * 3/1998 Menaged ..... A47B 23/043 248/455
5,826,732 A * 10/1998 Ragsdale ..... A47F 5/116 108/165
5,868,367 A * 2/1999 Smith ..... A47F 5/112 248/459
6,068,140 A * 5/2000 Mangrum ..... A47F 5/116 108/165
6,092,673 A * 7/2000 Woolnough ..... A47F 7/146 211/50
6,116,436 A * 9/2000 Ferrucci ..... G11B 33/0444
6,715,623 B2 * 4/2004 Broerman ..... A47F 5/116 211/149
6,752,280 B2 * 6/2004 Dye ..... A47F 5/116 108/162
6,871,750 B2 * 3/2005 Moss ..... A47F 5/116 211/195
7,571,820 B2 * 8/2009 Alexander ..... A47F 5/10 211/73
7,731,039 B1 * 6/2010 Minger ..... A47F 7/0078 229/114
7,905,365 B2 * 3/2011 Virvo ..... A47F 5/116 211/73
7,967,154 B1 * 6/2011 Sharon ..... A47J 47/16 211/72
8,540,091 B2 * 9/2013 Kristensen ..... A47F 5/10 312/258
9,809,043 B2 11/2017 Tauber
9,901,174 B1 * 2/2018 Conrad ..... A47B 97/08
11,337,531 B2 * 5/2022 Zhang ..... A47F 5/11
11,457,751 B2 * 10/2022 Nguyen ..... A47F 5/116
11,478,076 B2 * 10/2022 Gibbons, Jr. ..... A47F 5/116
2010/0051568 A1 * 3/2010 Kalwat ..... A47F 5/116 211/149
2010/0181443 A1 * 7/2010 Bojie ..... A47F 5/11 108/51.11
2013/0264923 A1 * 10/2013 Brady ..... A47B 43/02 312/258
2016/0095453 A1 * 4/2016 Frost ..... A47F 7/147 211/186
2018/0168369 A1 * 6/2018 Goldmeier ..... A47B 57/58
2018/0289178 A1 * 10/2018 McMillan-Sweat .... A47F 5/116
2020/0077816 A1 * 3/2020 Doane ..... A47B 43/02
2020/0375375 A1 * 12/2020 Robinson ..... A47B 55/06
2021/0251400 A1 * 8/2021 Coan ..... B65D 25/04
2023/0090599 A1 * 3/2023 Battilana ..... A47F 5/10 211/135

FOREIGN PATENT DOCUMENTS

| | | | |
|---|---|---|---|
| CN | 105658438 | A | 6/2016 |
| CN | 209644492 | U | 11/2019 |
| EP | 3205240 | A2 | 8/2017 |
| EP | 3387960 | A1 | 10/2018 |
| EP | 3482657 | A1 | 5/2019 |
| FR | 2956959 | A1 | 9/2011 |
| GB | 2493442 | A | 2/2013 |
| WO | WO 97/48309 | A1 | 12/1997 |
| WO | WO 2015/004513 | A1 | 1/2015 |
| WO | WO 2021/164902 | A1 | 8/2021 |

OTHER PUBLICATIONS

Search Report in corresponding International Patent Application No. PCT/EP2020/079656, mailed Feb. 10, 2021, in 5 pages.

* cited by examiner

SHEET FOR THE ASSEMBLY OF A DISPLAY SHELVING UNIT AND THE DISPLAY SHELVING THUS OBTAINED

FIELD OF THE INVENTION

The present invention relates to the field of the means used for the storage and display of various articles, and relates more particularly to a sheet, also named as template, for the assembly of a display shelving unit, designed on the basis of reyclable materials such as metallic materials, made by a simple manufacturing process, since the sheet comprises a single piece, which occupies a minimum space, thus allowing to transport a larger number of sheets for the assembly of display shelving units and reduce transportation costs; in addition, the display shelving units can be assembled and disassembled in a practical, fast and safe way.

Even though the present description relates more particularly to a sheet for the assembly of a display shelving unit for various products, it will be understood that, due to the structural simplicity of the present invention, it can be adapted and employed in any construction mode for the assembly of units of various sizes and proportions, and for various purposes.

DESCRIPTION OF THE PRIOR ART

Display shelving units are well known in the art, and it is widely recognized that they allow for the storage and display of various products for sale, such as sweets, snacks, personal care items, cookies, magazines, and the like. Typically, the units can be made of virgin raw materials, which are processed in multiple production steps, the result of which is a final product. However, such processes involve high costs and long operation times. At the end of the manufacturing process, the display units may have either been provided with their final shape for immediate use, or be delivered in a sheet configuration, which can be folded into its final configuration by means of special tools.

One type of display unit is the one disclosed in U.S. Pat. No. 6,966,447, which comprises a upright display stand on which a hanging display tray made from a corrugated carboard blank is mounted. The stand comprises a rectangular front panel with a locking slot for the coupling of a transverse brace to the upper edge of the front panel, which in turn comprises spaced apart notches for the engagement of hooks on the rear face of the hanging display tray. The stand also comprises a first integral side panel and a second integral side panel of generally triangular configuration, and a rear panel. The upper end of the rear panel includes an integral reinforcement brace which folds downwardly and inwardly to engage the locking slot formed in the front panel to create the transverse brace. The display stand, when fully assembled, is generally rigid and stable and well suited to support a hanging tray.

Another type of display unit is the one disclosed in U.S. Pat. No. 4,493,424, which can be constructed in a single foldable sheet of any suitable material (cardboard preferred). Such a display stand has "folding lines" along which the display stand is folded. Still another type of display stand is the one disclosed in U.S. Pat. No. 4,723,664, which is made of cardboard or a similar material, comprising more than one piece. Such display stand is foldable, the parts thereof are engaged and folded by means of elastic bands.

Still another type of display unit is the one disclosed in Patent EP0335258, comprising a rigid plastic display box made of a single foldable piece. This display unit has "folding lines" along which the display stand is folded, and the parts are bonded by means of an adhesive product. Another type of display stand is the one disclosed in U.S. Pat. No. 7,367,539, which is made of foldable cardboard, comprising more than one piece, and supported by means of elastic cords. Further, Patent EP2589318 discloses a display stand made of foldable cardboard, comprising more than one piece, which trays are bonded by means of an adhesive product. Still another type of display unit is disclosed in U.S. Pat. No. 6,098,820, which is made of foldable cardboard, comprising more than one piece with folding lines.

Although the above mentioned display trays have proven effective in practice, several disadvantages still persist. One of them relates to the use of new unused raw materials for the construction of the display unit, making them less sustainable regarding the environment. Another disadvantage is the short useful life of the display trays made with materials such as cardboard o plastics, which, although they may be recyclable, are not strong enough so to be durable over time. Cardboard or plastic display stands also allow for the affixing or printing of advertisements, thus limiting their use to a single product type. Another drawback relates to production processes. Nowadays, processes for the manufacturing or production of display stands require multiple labor-intensive processes, with high transportation and storage costs involved, since the transportation of large volumes demands large amounts of energy. Furthermore, since nowadays there is no control of the final destination of display stands once they reach the end of their useful life, the uncontrolled disposal of waste causes a significant negative impact on the environment. The fact that the display stands of the prior art need to be assembled using special tools and applying appropriate adhesive products to provide for structure stability in use, implies a drawback upon disassembling the stand when it reaches the end of its useful life, making it difficult to recycle them manually. As mentioned above, some display stands have to be transported in a pre-assembled fashion. Because of their size, the number of units that can be transported together in the same shipment is limited, thus increasing transportation costs.

Given the state of the art currently available for display trays and stands, it is very convenient to develop a new type of display unit which is environmentally friendly and sustainable, sturdy and durable over time, which can be assembled and disassembled in a practical, fast and safe way, without the need of special tools or other consumables, allowing for an increase in the number of units that can be transported together in the same shipment and thus reduce the associated costs. Since the display trays of the present invention are made of metallic materials, they also allow for the use of magnetic advertisement labels which can be easily removed once the display tray is no longer used for displaying a given product.

BRIEF DESCRIPTION OF THE INVENTION

It is therefore an object of the present invention to provide a new sheet for the assembly of a display shelving unit for products on sale, which comprises a simple structure that may be assembled and disassembled in a practical, fast and safe manner.

It is still another object of the present invention to provide a sheet made of recyclable materials, such as metallic materials. For example, any foldable metallic material can be employed, for example, steel plate, galvanized steel plate, prepainted steel plate, stainless steel, aluminum, alucobond, or the like.

It is still another object of the present invention to provide a novel single-piece sheet which reduces the number of manufacturing processes needed for its production.

It is still another object of the present invention to provide a sheet of reduced volume, so that a greater number of units can be transported in each shipment.

It is still another object of the present invention to provide a sheet which can be manually assembled without the need for tools and/or additional consumables.

It is still another object of the present invention to provide a sheet which is practical to be disassembled once the end of the useful life of the display tray has been reached, in order to facilitate its recycling.

It is still another object of the present invention to provide a sheet allowing to optimize the physical spaces required for both storage and transportation.

It is still another object of the present invention to provide a metallic sheet for the assembly of a piece of furniture that can be used to display various articles on sale, where the sheet comprises at least one main panel with an upper free edge and a lower free edge and at least multiple folding die-cuts along at least two folding lines; at least one sub-panel of the main panel, arranged between such at least two folding lines forming a support panel/tray, and a guard flap below one of such folding lines and ending at said lower free edge of the sheet, where said main panel, sub-panel of the main panel and guard flap all together form a single piece of metallic material.

It is still another object of the present invention to provide a sheet for the assembly of a display tray for various articles on sale comprising: at least one main panel having folding edges and at least a plurality of lower folding die-cuts interconnected along a folding line; at least one tray sub-panel comprised within said main panel; at least one pair of alar side panels which are arranged and folded around said main panel along the folding edges; and at least one lower base sub-panel comprising a portion with side folding edges around which also such alar side panels are folded, and at least a plurality of folding die-cuts.

It is still another object of the present invention to provide a display tray formed by means of the folding and assembly of the sheet of the present invention, where the display has a bottom portion formed by said main panel, which is folded along one of such folding lines so that said sub-panel of the main panel is arranged horizontally forming a tray(support base), which sub-panel of the main panel is folded along the other of such at least two folding lines so that said guard flap extends upwards and ends at said lower free edge of the sheet.

It is still another object of the present invention to provide a display tray formed by folding and assembling of the sheet of the present invention, where the display has a bottom portion which is formed by said lower base sub-panel which is folded along said folding line of the upper folding die-cuts, being said foldable guard flap of the lower base sub-panel also folded; a rear wall being formed by said main panel and one portion of said lower base sub-panel; having the display side walls formed by such alar side panels which are folded along said folding edges of the main panel and lower base sub-panel; and at least one tray formed by said sub-panel of the tray which is folded along the folding line of the folding die-cuts of the main panel, being additionally said guard flap with free edge folded along the folding line of the lower folding die-cuts of the tray sub-panel.

It is still another object of the present invention to provide a display tray having a bottom portion, at least a tray, and side walls, obtained by using the sheet, where the bottom portion is formed by said lower base sub-panel which is folded along said folding line of the upper folding die-cuts thereof, being said foldable guard flap of the lower base sub-panel additionally folded; the rear wall is formed by said main panel and one portion of said lower base sub-panel; the side walls are formed by such alar side panels which are folded along said folding edges of the main panel and lower base sub-panel; and the tray is formed by said sub-panel of the tray which is folded along the folding line of the folding die-cuts of the main panel, being additionally said guard flap with free edge folded along the folding line of the lower folding die-cuts of the tray sub-panel.

BRIEF DESCRIPTION OF THE DRAWINGS

For the sake of clarity and better comprehension of the subject matter of the present invention, the invention has been illustrated by means of several drawings, in which the invention is represented in one of its preferred exemplary embodiments, where.

DETAILED DESCRIPTION OF THE INVENTION

Making reference to the figures, it will be appreciated that the invention consists in a novel sheet for the assembly of a single-piece display shelving which, thanks to its structural simplicity, can be manually assembled and disassembled in a practical, fast and easy way, without the need of tools or additional consumables, which can also be recycled, since it is made of reyclable materials such as metallic materials, which require fewer production processes, and where, thanks to its reduced volume, allow for the transportation of a larger number of units in the same shipment, thus significantly reducing the related costs.

Figure 1A:
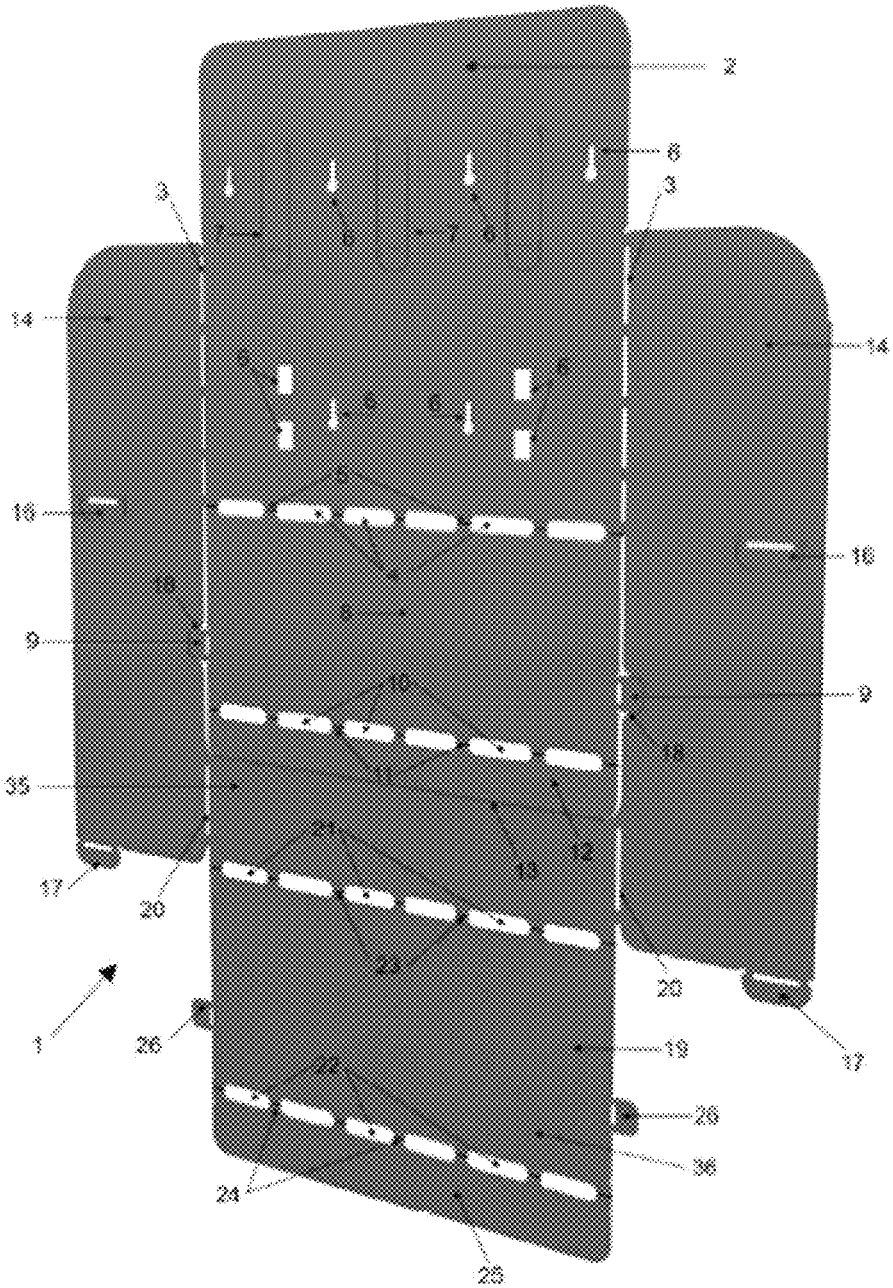
FIG. 1A shows a perspective view of the sheet of the present invention in a first preferred embodiment and according to the present invention.
Figure 1B:
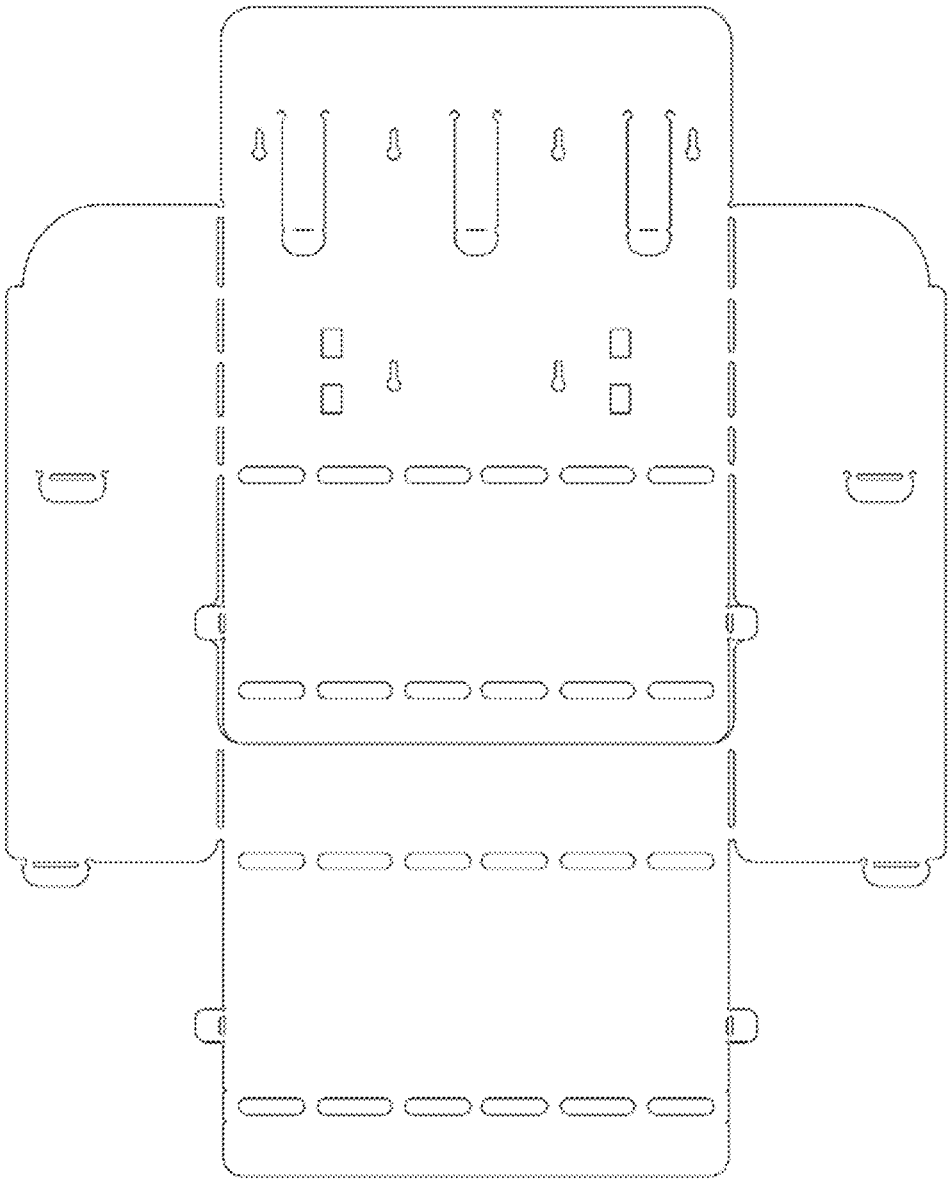
FIG. 1B shows a front view of the sheet of the present invention in a first preferred embodiment and according to the present invention.
Figure 2A:
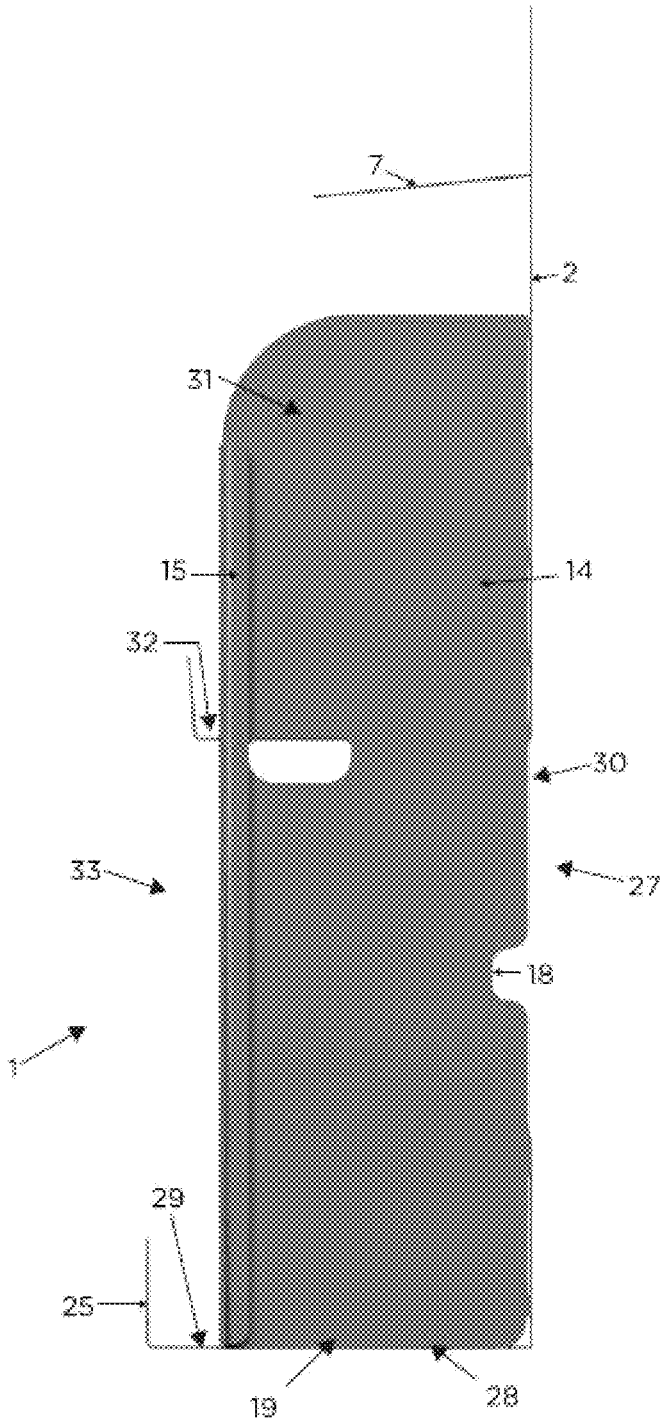
FIGS. 2 (A and B) shows a side view of a display tray assembled on the basis of the sheet of FIG. 1 and according to the present invention.
Figure 2B:
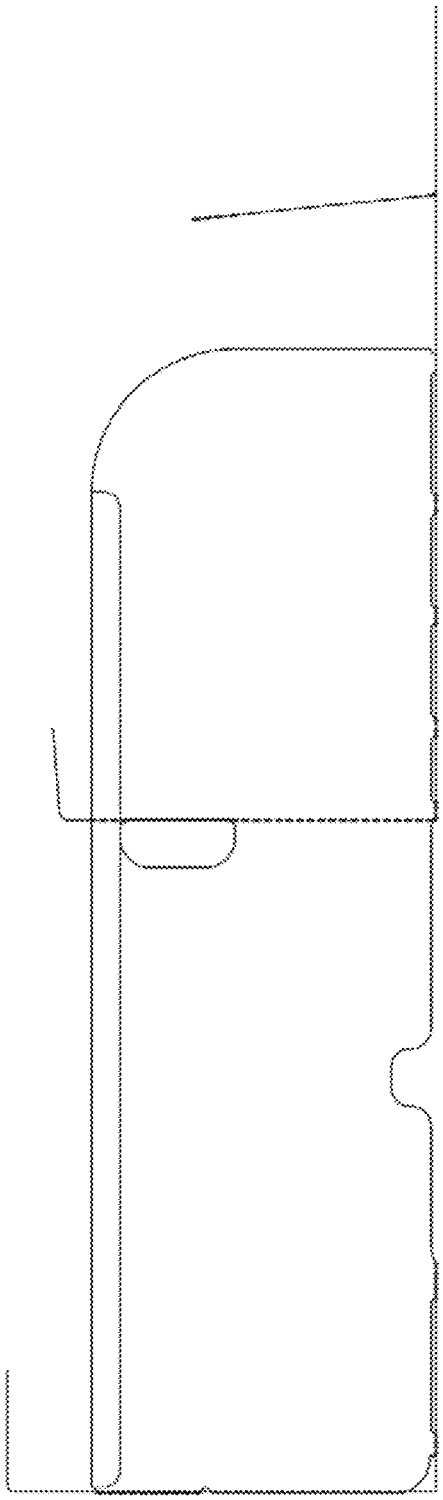
Figure 3A:
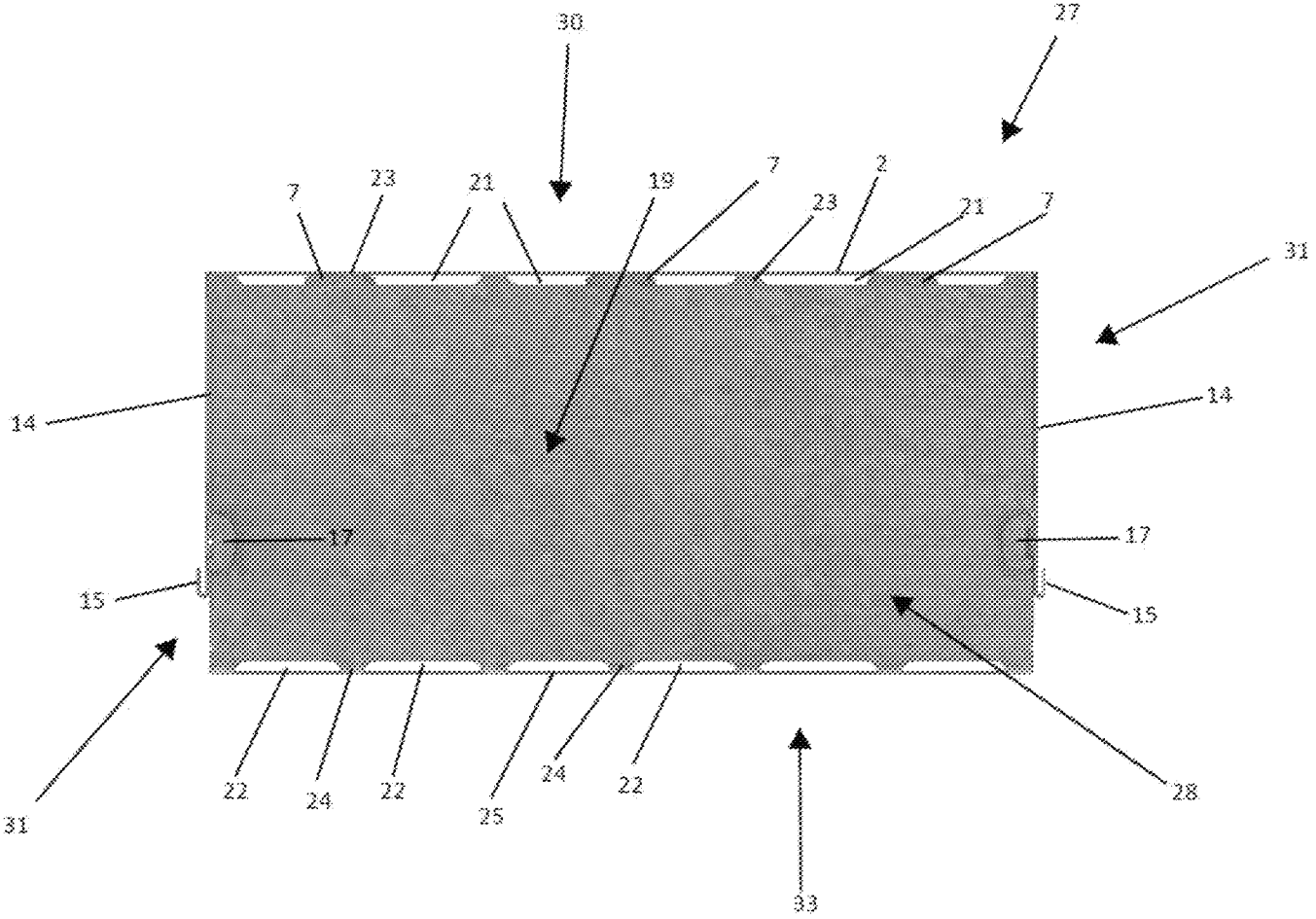
FIGS. 3 (A and B) shows a bottom view of the display shelving assembled on the basis of the sheet of FIG. 1 and according to the present invention.
Figure 3B:
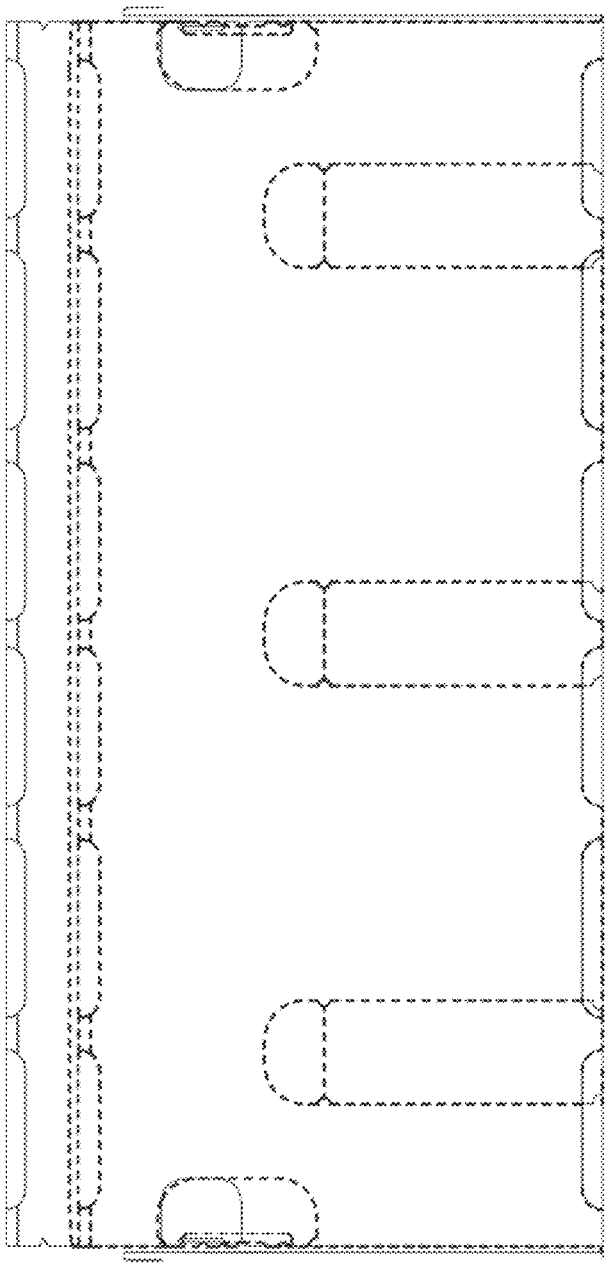

In one embodiment of the invention according to FIGS. 1 a 4, the sheet of the present invention is referred to with the general reference number 1 and comprises one main panel 2 with respective folding edges 3 and at least a plurality of lower folding die-cuts 4 interconnected along a folding line 5. The folding lines, like line 5 and the others, are virtual or imaginary lines along which the display shelving will be folded upon its assembly. Besides, said folding edges 3 comprise a dotted line which is not a limitation for the invention. Additionally, the main panel 2 has a plurality of secondary support cuts 6 on which "blister hooks" or the like can be respectively mounted and a plurality of foldable die-cut sections 7 which can be folded in order to allow for the hanging of various products. The arrangement of the secondary support cuts is not limited to the main panel, but can also be present in any other panel without any limitation.

Besides, the main panel 2 comprises at least one tray sub-panel 8 having at least one pair of foldable side fixing flaps 9, and at least a plurality of lower folding die-cuts 10 interconnected along a folding line 11, so that along said folding line 11 at least one guard flap 12 with a free edge 13 is folded. As can be seen in FIG. 1, the tray sub-panel 8 is arranged in one lower portion of the main panel 2, without this being a limitation for the invention.

Additionally, the present invention comprises at least one pair of alar side panels 14 which are arranged and folded around said main panel 2 along the folding edges 3. Where, each of such alar side panels 14 has at least one longitudinal side reinforcing member 15, at least one foldable die-cut reinforcing flap 16, at least one foldable lower reinforcing flap 17 and at least one perimeter cutout 18 matching with an edge of said foldable side fixing flap 9 of the sub-panel 8.

Besides, at least one lower base sub-panel 19 is provided which has a fixed portion 35 and a foldable portion 36, where said fixed portion 35 comprises one portion with side folding edges 20 around which also such alar side panels are folded 14. Additionally, said lower base sub-panel 19 comprises at least a plurality of folding die-cuts which are defined by upper folding die-cuts 21 and lower folding die-cuts 22, being each of the die-cuts groups interconnected along respective folding lines 23-24 so that a foldable guard flap 25 is folded along the folding line 24 interconnecting the lower folding die-cuts 22. Besides, the lower base sub-panel 19 comprises at least one pair of reinforcing foldable flaps 26.

To perform the assembly of the display shelving from the sheet of FIG. 1 and according to the first preferred embodiment, first the foldable side fixing flaps 9 of the tray sub-panel 8 are folded by 90° (in the "outwards" or "forward" direction of FIG. 1), then folding by 90° with respect to the same in a first stage along the folding line 5 of the lower folding die-cuts 4 of the main panel 2 (in the "outwards" or "forward" direction of FIG. 1), then ending in a second stage where the guard flap 12 is folded by 90° "upwards" along the folding line 11 of the lower folding die-cuts 10 of the tray sub-panel 8.

Then, the reinforcing foldable flaps 26 of the lower base sub-panel 19 are folded by 90° (in the "outwards" or "forward" direction of FIG. 1), then the foldable portion 36 is folded by 90° in a first stage along the folding line 23 of the upper folding die-cuts 21 (in the "outwards" or "forward" direction of FIG. 1), and finally in a second stage the foldable guard flap 25 is folded by 90° "upwards" along the folding line 24 of the lower folding die-cuts 22 of the lower base sub-panel 19. After that, the alar side panels 14 are folded by 90° (in the "outwards" or "forward" direction of FIG. 1) along the folding edges 3-20, and finally the die-cut foldable reinforcing flaps 16 and lower foldable reinforcing flap 17 are folded by 90° "downwards", so to provide structural reinforcement to the display shelving.

It should be underlined that the arrangement of the folding die-cuts 4, 10, 21 and 22 will allow for a more practical and easy folding, which can be performed manually without the need for special tools or equipment, which is a significant advantage in terms of cost and operation time savings. Besides this allows for the disassembly in a practical, fast and trouble-free way. Additionally, the invention is not limited to the assembly stages mentioned hereinbefore, but the order of the assembly/disassembly stages can be freely altered according to each end user preferences, since the assembly/disassembly can be performed manually without any problem. Therefore, the disassembly is performed either in a reverse order, or in any way deemed more convenient by each individual end user, in a practical, fast and easy way, thanks to its structural simplicity.

Figure 4A:
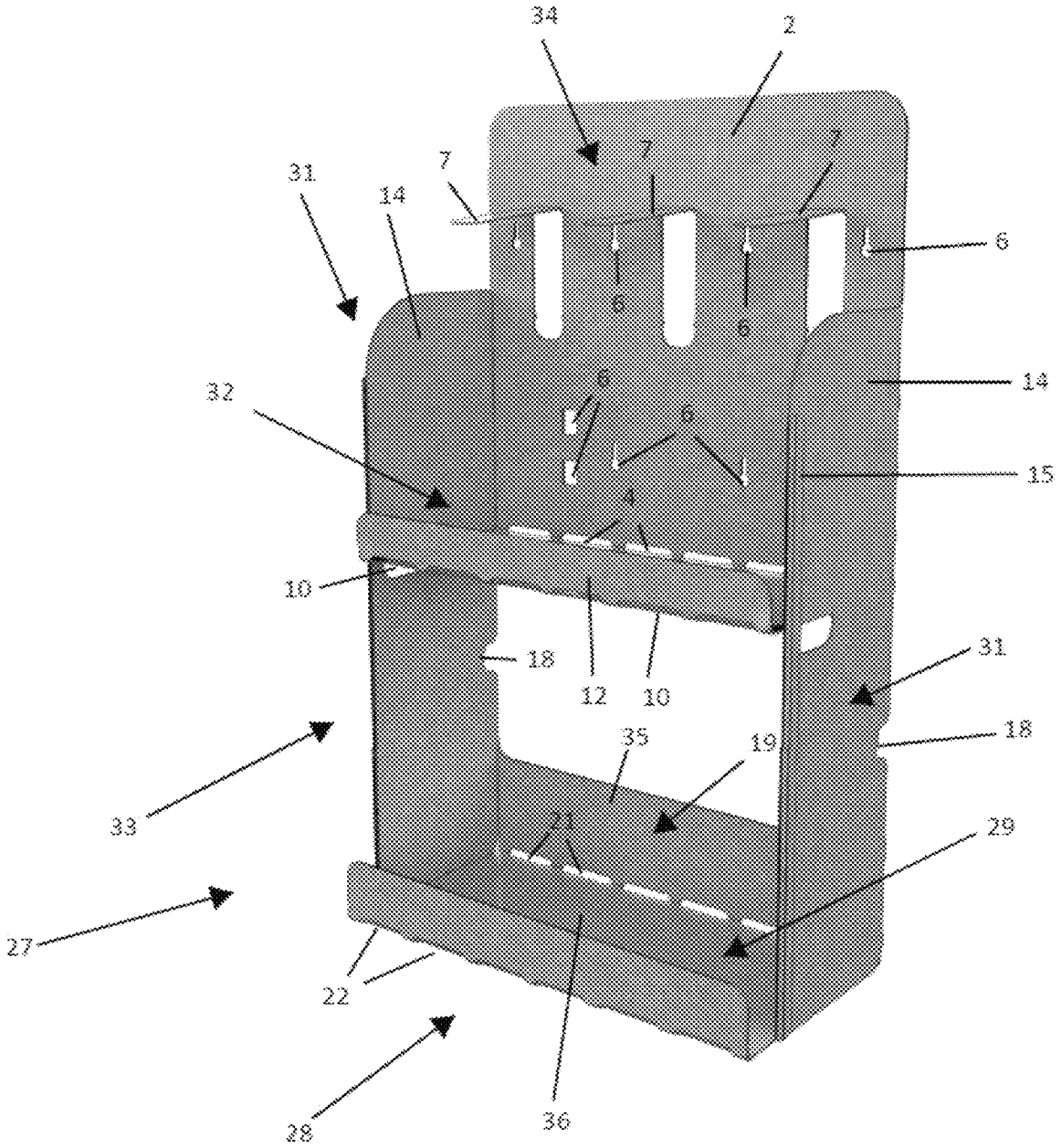
FIGS. 4 (A and B) shows a perspective view of the display shelving assembled on the basis of the sheet of FIG. 1 and according to the present invention.
Figure 4B:
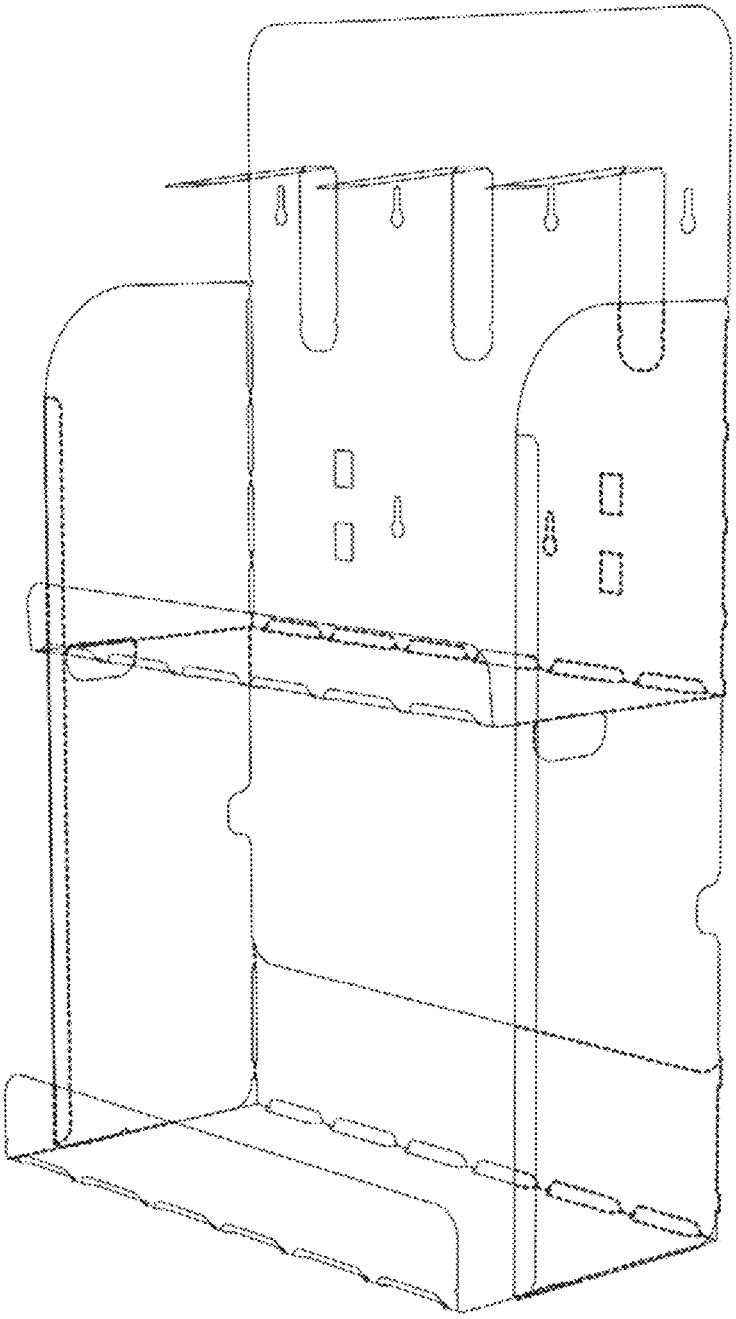

Therefore, as shown in FIG. 4, a display shelving unit 27 is obtained, which has a bottom portion 28 formed by said lower base sub-panel 19 which is folded along said folding line 23 of the upper folding die-cuts 21 thereof, being said foldable guard flap 25 of the lower base sub-panel 19 additionally folded. At least one lower compartment 29 is thus defined for the display of various products on sale. Additionally, the display shelving 27 of the present invention has a rear wall 30 formed by said main panel 2 and one portion of said lower base sub-panel 19.

Side walls 31 are formed by such alar side panels 14 which are folded along said folding edges 3-20 of the main panel 2 and lower base sub-panel 19. Besides, at least one tray 32 is defined, which is formed by said tray sub-panel 8 which is folded along the folding line 5 of the lower folding die-cuts 4 of the main panel 2, additionally said guard flap 12 with free edge 13 being folded along the folding line 11 of the lower folding die-cuts 10 of the tray sub-panel 8. The display shelving 27 of the present invention has a display front 33 through which the products to be sold/displayed will be placed or withdrawn. Additionally, a hanging section 34 is defined from the foldable die-cut sections 7 to hang those products that can be hanged, either independently or together with other associated items.

Figure 5A:
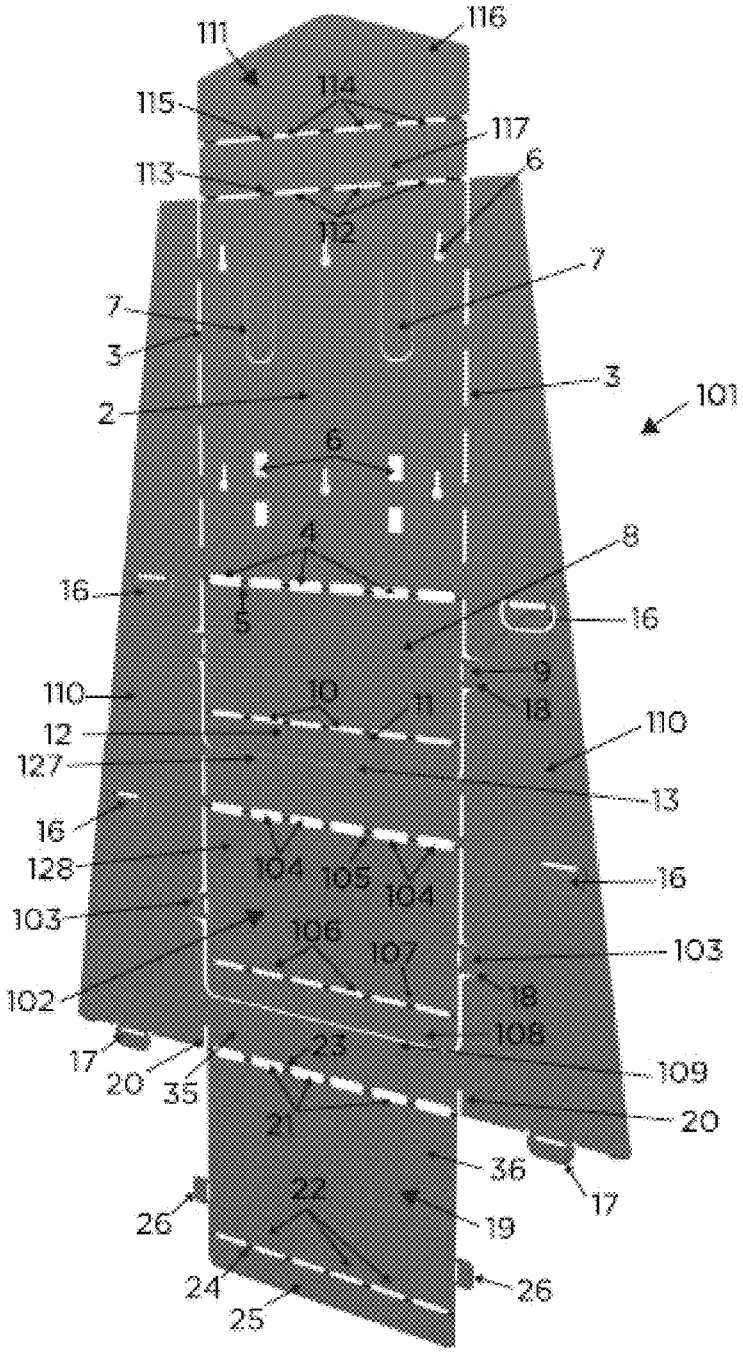
FIG. 5A shows a perspective view of the sheet of the present invention according to a second preferred embodiment.
Figure 5B:
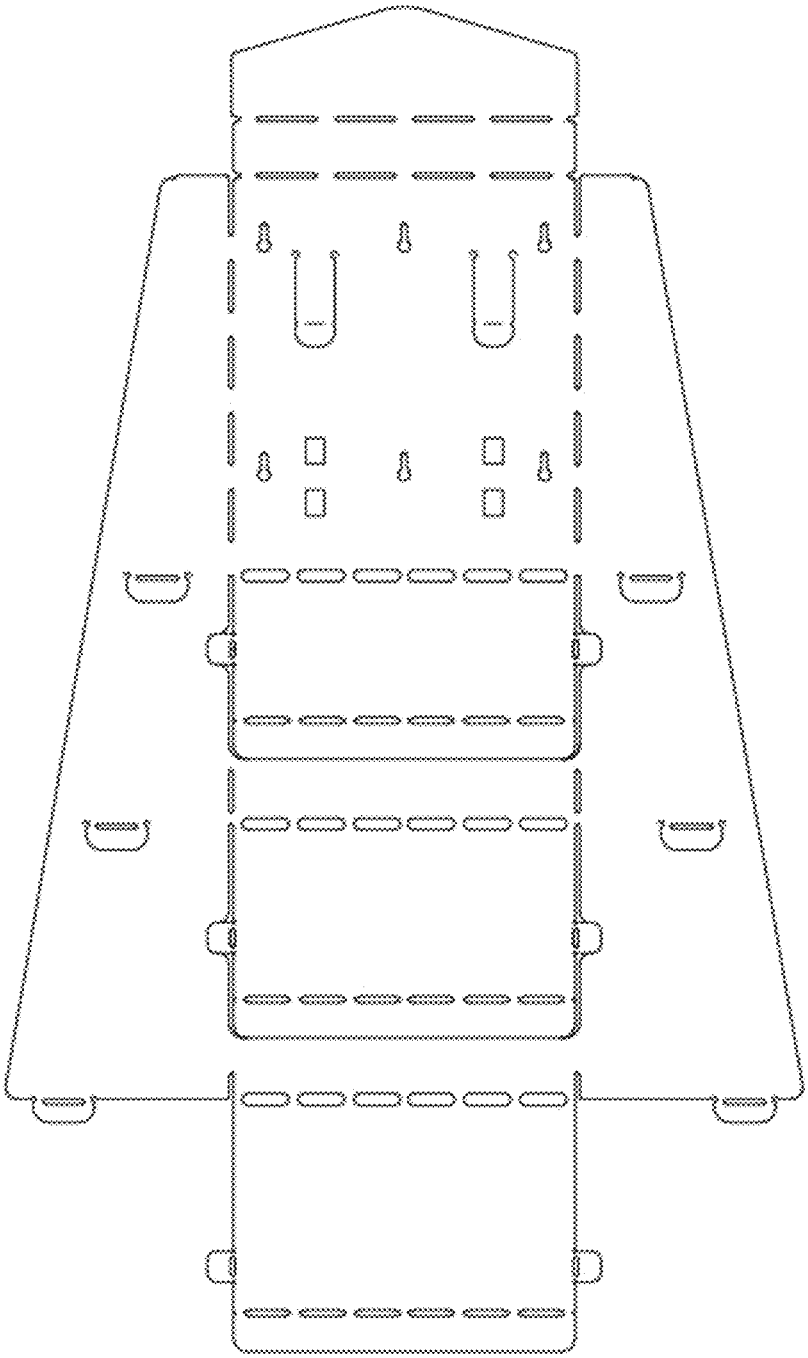
FIG. 5B shows a front view of the sheet of the present invention according to a second preferred embodiment.
Figure 6A:
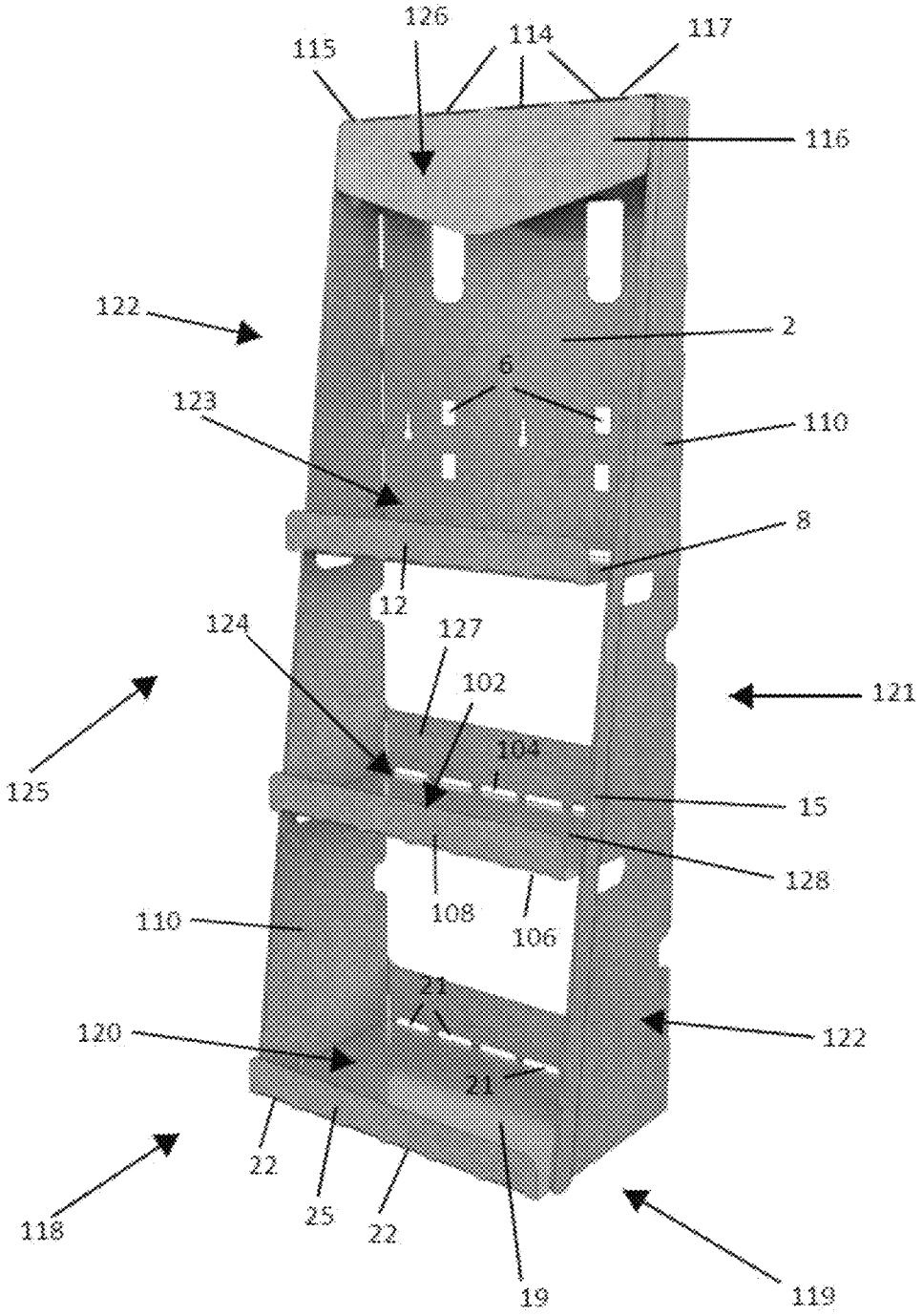
FIGS. 6 (A and B) shows a perspective view of a display shelving unit assembled on the basis of the sheet of FIG. 5.
Figure 6B:
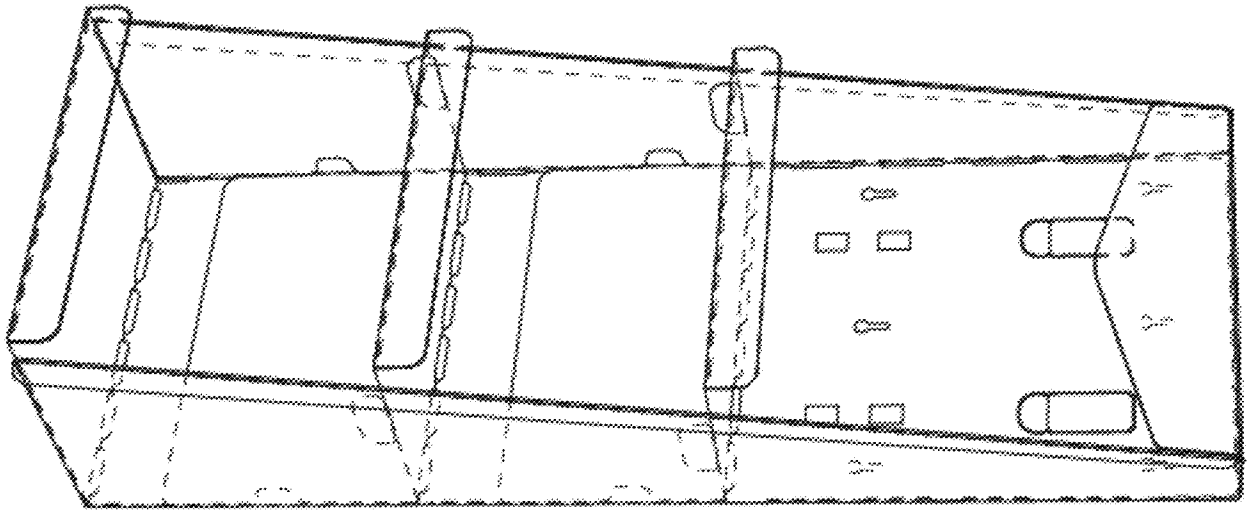

In a second preferred embodiment, and according to FIGS. 5 and 6, the sheet of the present invention is referred to with the general reference number 101. The same reference numbers used hereinabove will still be used to identify those parts identical to those in the first embodiment, while new parts in the second embodiment will be referred to with reference numbers starting by number 100.

Unlike the case of the first preferred embodiment, the sheet 101 comprises a second tray sub-panel 102 which has a fixed portion 127 and a foldable portion 128. Said second tray sub-panel 102 has respective foldable side fixing flaps 103, at least a plurality of upper folding die-cuts 104 interconnected along a folding line 105, and a plurality of lower folding die-cuts 106 interconnected along a folding line 107, so that at least one guard flap 108, which also has a free edge 109, is folded along said folding line 107. Respective alar side panels 110 of trapezoidal shape are provided, without this being a limitation for the invention.

Additionally, the sheet 101 of the second preferred embodiment has at least one marquee sub-panel 111 arranged on the upper portion of the main panel 2, said marquee sub-panel 111 comprising at least a plurality of lower folding die-cuts 112 interconnected along a folding line 113, and at least a plurality of upper folding die-cuts 114 interconnected along a second folding line 115 around which a foldable marquee flap 116 is folded. Said marquee sub-panel 111 also has a marquee roof section 117 defined between said folding die-cuts 112-114.

In order to perform the assembly of the sheet 101, the procedure is the same as with the first embodiment, except that after folding the first tray sub-panel 8, the foldable portion 128 of the second tray sub-panel 102 must be folded, first along the folding line 105 of the upper folding die-cuts 104 and then folding the guard flap 108 along the folding line 107 of the lower folding die-cuts 106. Then the lower base sub-panel 19 and alar side panels 110 are folded the same as in the first embodiment, to end with el marquee sub-panel 111. To that end, first the marquee roof section 117 is folded by 90° (in the "outwards" or "forward" direction of FIG. 5) along the folding line 113 of the lower folding die-cuts 112, and finally a foldable marquee flap 116 is folded by 90° "downwards" along the folding line 115 of the upper folding die-cuts 114.

As already stated hereinbefore, the invention is not limited to the previously mentioned assembly stages, but the order of the assembly/disassembly stages can be freely altered according to each end user preferences, since the assembly/disassembly can be performed manually without any problem. Therefore, the disassembly is performed either in a reverse order, or in any way deemed more convenient by each individual end user, in a practical, fast and easy way, thanks to its structural simplicity.

In FIG. 6, a display shelving unit 118 is obtained which has a bottom portion 119 is formed by said lower base sub-panel 19 which is folded along said folding line 23 of the upper folding die-cuts 21 thereof, being said foldable guard flap 25 additionally folded of the lower base sub-panel 19. At least one lower compartment 120 is so defined for the display of various products on sale. Additionally, the display shelving 118 of the present invention has a rear wall 121 formed by said main panel 2, and one portion of said second tray sub-panel 102 and lower base sub-panel 19.

Respective side walls 122 are formed by such alar side panels 110 which are folded along said folding edges 3-20 of the main panel 2 and lower base sub-panel 19. Besides, at least one upper tray 123 and one lower tray 124 are defined. Where, said upper tray 123 is formed by said tray sub-panel 8 which is folded along the folding line 5 of the lower folding die-cuts 4 of the main panel 2, being said guard flap 12 with free edge 13 additionally folded along the folding line 11 of the lower folding die-cuts 10 of the tray sub-panel 8. While said lower tray 124 is formed by said second tray sub-panel 102 which is folded along the folding line 105 of the upper folding die-cuts 104, being said guard flap 108 with free edge 109 additionally folded along the folding line 107 of the lower folding die-cuts 106 of the tray sub-panel 102.

The display shelving 118 of the present invention has a display front 125 through which the products for sale/display will be placed or withdrawn. Additionally, a marquee front 126 is defined, formed by said foldable marquee flap 116 which is folded along the folding line 115 of the upper folding die-cuts 114. a display shelving unit 118 is thus obtained with a larger number of trays and with a marquee front 126 to allow the advertising of one or more brands or products.

Figure 7A:
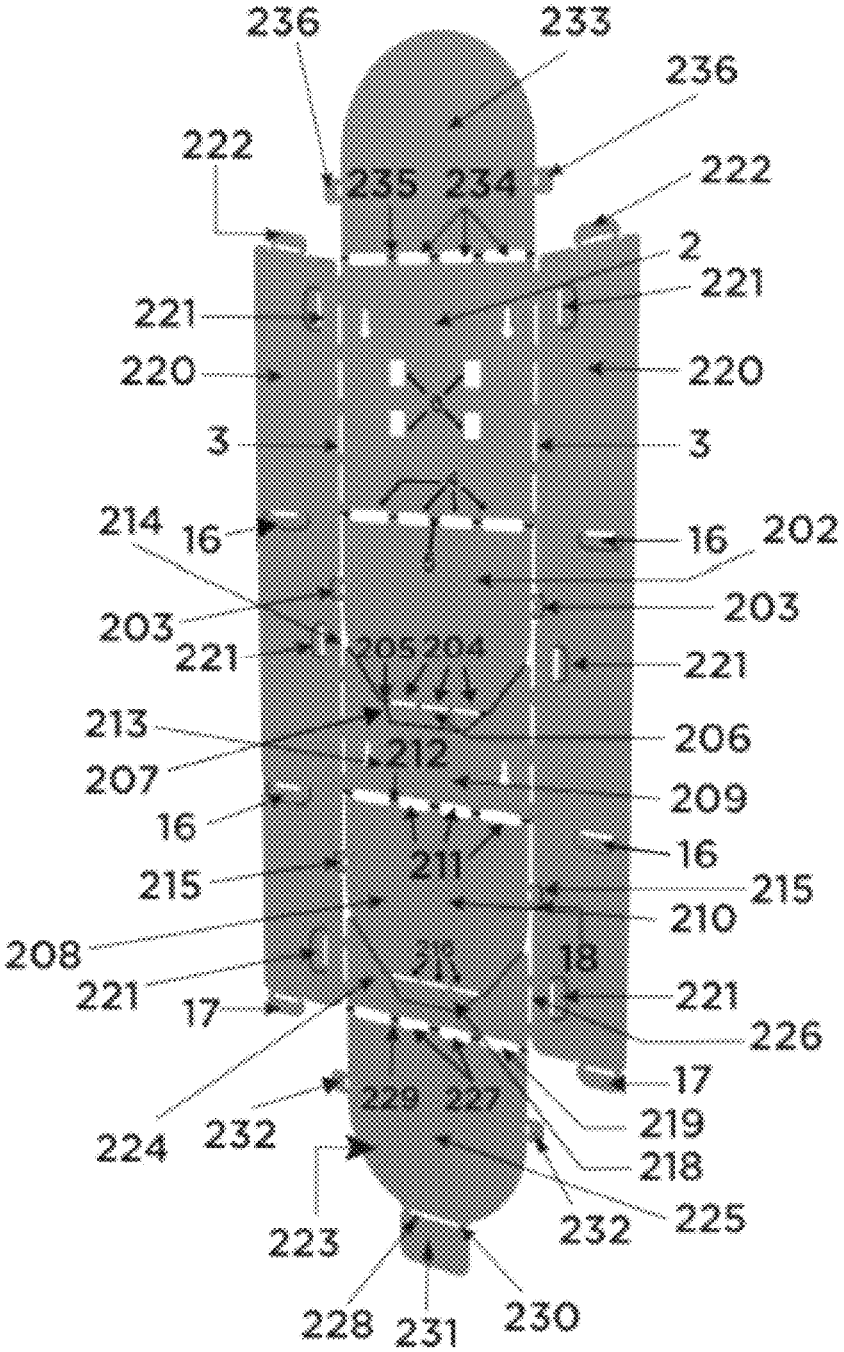
FIG. 7A shows a perspective view of the sheet of the present invention according to a third preferred embodiment.
Figure 7B:
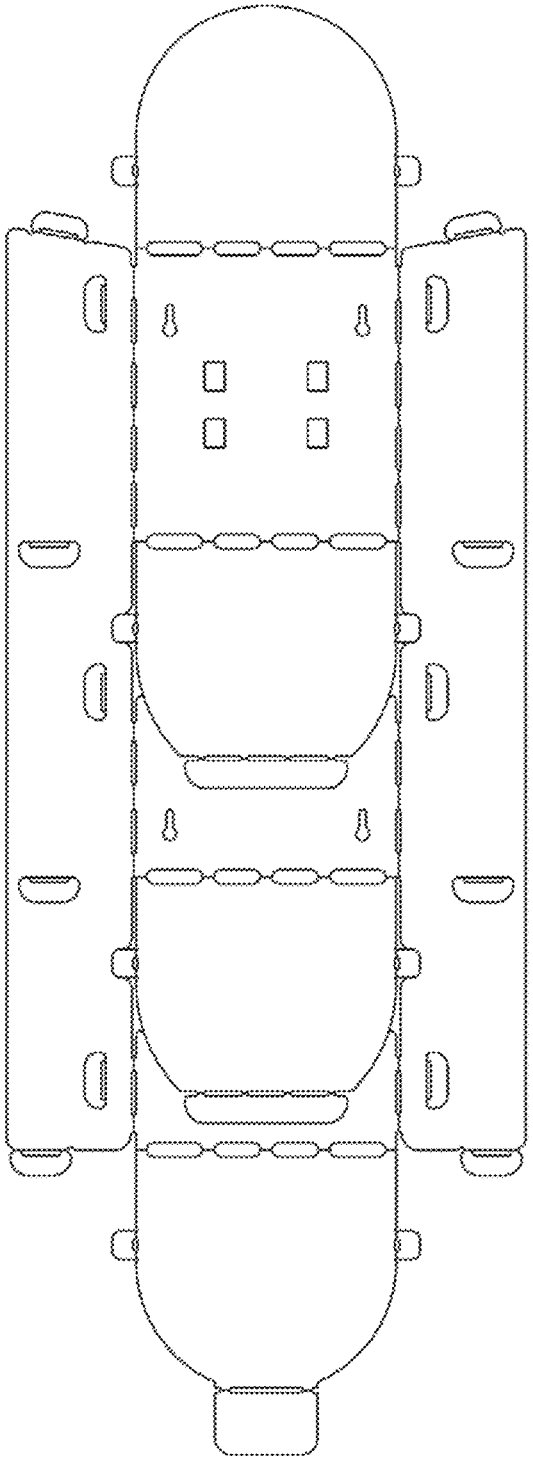
FIG. 7B shows a front view of the sheet of the present invention according to a third preferred embodiment FIGS. 8 (A and B) shows a perspective view of a display shelving unit assembled on the basis of the sheet of FIG. 7.
Figure 8A:
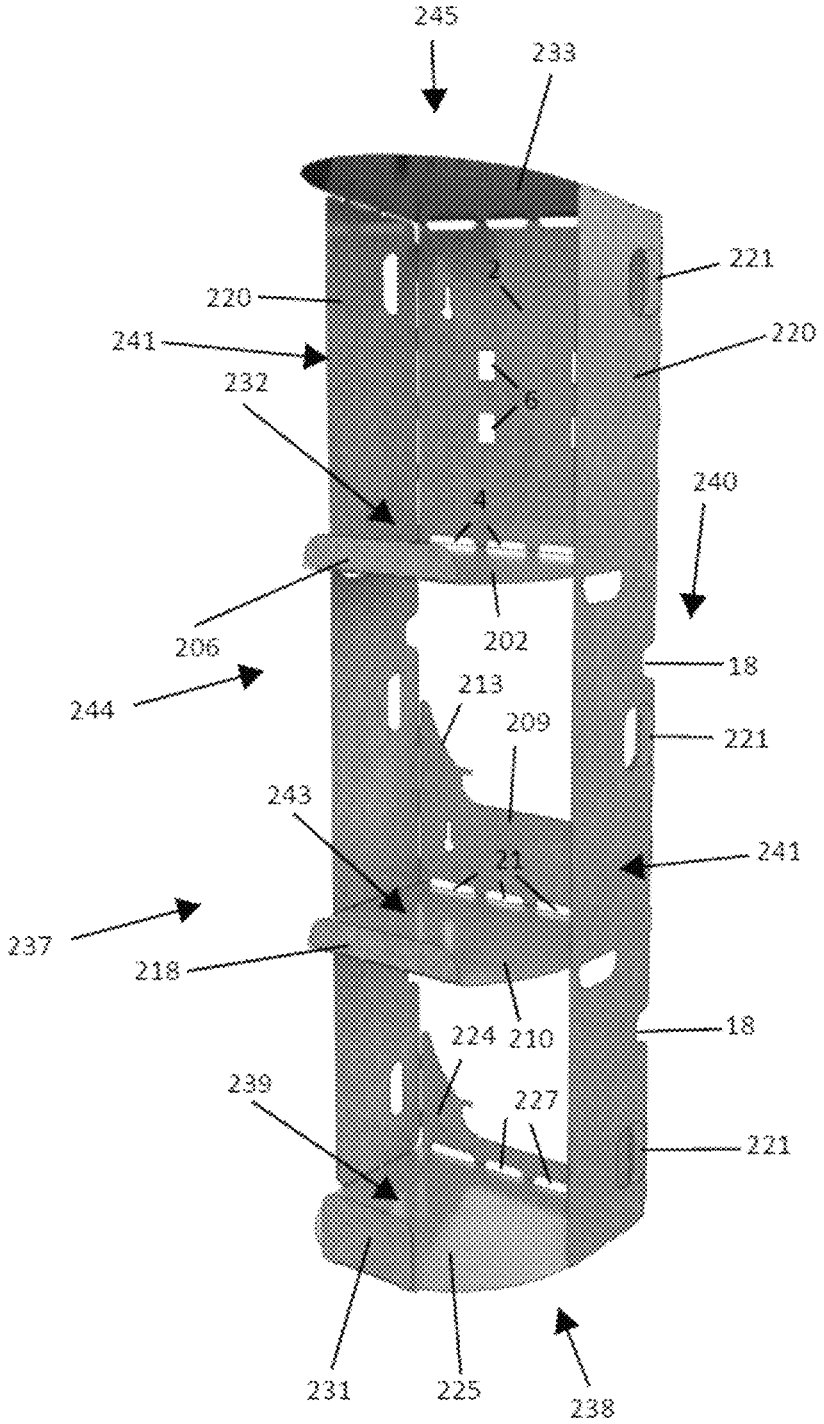
Figure 8B:
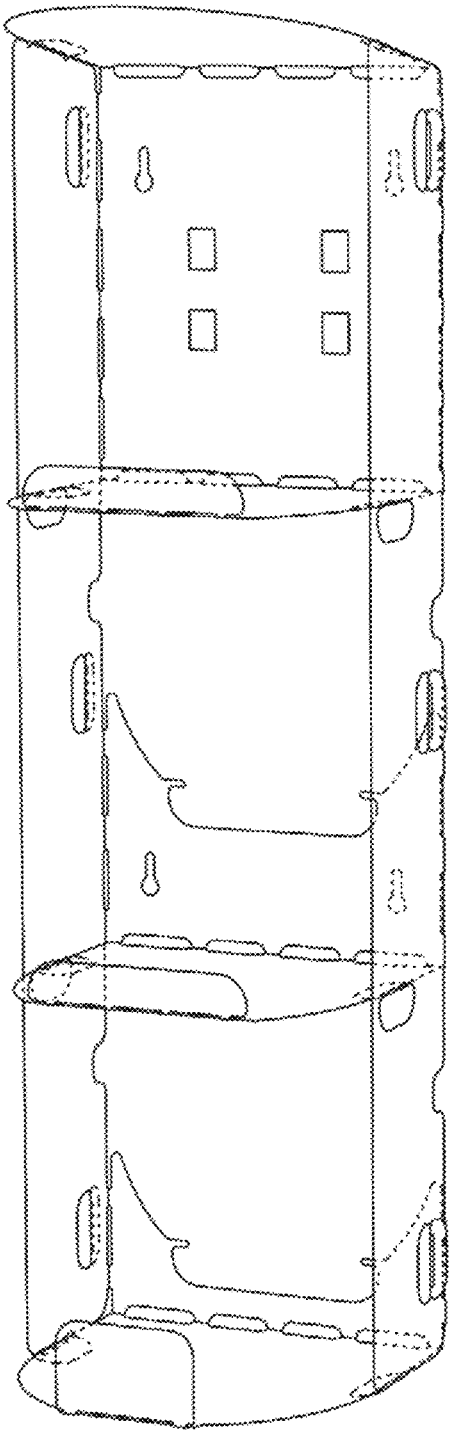

According to a third preferred embodiment, as shown in FIGS. 7 and 8, the sheet is referred to with the general reference number 201. The same reference numbers used hereinabove will still be used to identify those parts identical to those in the first embodiment, while new parts in the second embodiment will be referred to with reference numbers starting by number 200.

Unlike the case of the first preferred embodiment, the sheet 201 of the present invention has a first tray sub-panel 202 which is folded along the folding line 5 of the lower folding die-cuts 4 of the main panel 2. Said first sub-panel 202 has a curved stepped shape with at least one pair of foldable side fixing flaps 203, and at least a plurality of lower folding die-cuts 204 interconnected along a folding line 205, where at least one guard flap 206 which has a free edge 207 is folded along said folding line 205.

Additionally, a second tray sub-panel 208 is provided which has a fixed portion 209 and a foldable portion 210, where both parts are connected along respective folding die-cuts 211, which are in turn interconnected along a folding line 212. The fixed portion 209 has one upper portion 213 which shape is supplementary to the shape of the lower portion 214 of the first tray sub-panel 202. The foldable portion 210 of the second tray sub-panel 208 has at least one pair of foldable side fixing flaps 215, and at least a plurality of lower folding die-cuts 216 interconnected along a folding line 217, where at least one guard flap 218 with a free edge 219 is folded along said folding line 217.

Besides, unlike the first embodiment, each of the alar side panels 220 have at least one pair of upright foldable die-cut reinforcing flaps 221 and at least an upper foldable reinforcing flap 222. At least one lower base sub-panel 223 is provided having a fixed portion 224 which upper portion is supplementary to the shape of the lower portion of the foldable portion 210 of the second tray sub-panel 208, and a foldable portion 225 with curved stepped shape. As in the first embodiment, the fixed portion 224 comprises one portion with side folding edges 226 around which also such alar side panels 220 are folded.

Additionally, said lower base sub-panel 223 comprises at least a plurality of folding die-cuts which are defined by upper folding die-cuts 227 and a lower folding cutout 228, being each of the die-cut groups interconnected along respective folding lines 229-230, where a foldable guard flap 231 is folded along the folding line 230 of the lower folding cutout 228. Besides, the lower base sub-panel 223 comprises at least one pair of reinforcing foldable flaps 232.

The sheet 201 according to the third preferred embodiment has at least one upper roof sub-panel 233 connected to the upper portion of the main panel 2 through a plurality of folding die-cuts 234 interconnected along folding line 235, where additionally, said upper roof sub-panel 233 has at least one pair of reinforcing flaps 236.

To perform the assembly of the sheet 201 of the present invention, the procedure is the same as in the case of the first embodiment. Where, first the foldable side fixing flaps 203 and 215 are folded by 90°, then the sub-panels de tray 202 and 208 are respectively folded. In the case of the first sub-panel 202, it is folded along the folding line 5, while in the case of the second tray sub-panel 208, the foldable portion 210 is folded along the folding line 212. Finally, the guard flaps 206-218 are respectively folded along folding lines 205 and 217.

After that, the reinforcing foldable flaps 232 of the lower base sub-panel 223 are folded by 90°, then the foldable portion 225 is folded by 90° along the folding line 229. Finally, the guard flap 231 is folded by 90° along the folding line 230, after which the lower base sub-panel 223 ends in a folded state. Then, the reinforcing flaps 236 of the upper roof sub-panel 233 are folded by 90° and next it is folded by 90° along the folding line 235. Once the upper roof sub-panel 233 is folded, the alar side panels 220 are folded by 90°, and their respective flaps 16, 17, 221 and 222 are then folded in order to provide added structural rigidity to assembled display.

The same as in the first embodiment, in both the second and third embodiments, the folding die-cuts allow for a controlled folding of the portions thereof, so that the folding action can be performed easily and without the need for special tools or equipment. As mentioned hereinbefore, the invention is not limited to the assembly stages previously mentioned, but the order of the assembly/disassembly stages can be freely altered according to each end user preferences, since the assembly/disassembly can be performed manually without any problem. Therefore, the disassembly is performed either in a reverse order, or in any way deemed more convenient by each individual end user, in a practical, fast and easy way, thanks to its structural simplicity.

FIG. 8 shows a display shelving unit 237 which has a bottom portion 238 which is formed by the foldable portion 225 of said lower base sub-panel 223 which is folded along said folding line 229, being said foldable guard flap 231 of the lower base sub-panel 19 additionally folded. At least one lower compartment 239 is thus defined for the display of various products on sale. Additionally, the display shelving 237 of the present invention has a rear wall 240 formed by said main panel 2, and one portion of said second tray sub-panel 208 and lower base sub-panel 223.

Respective side walls 241 are formed by such alar side panels 220 which are folded along said folding edges 3-226 of the main panel 2 and lower base sub-panel 223. Besides, at least one upper tray 242 and one lower tray 243 are defined. Where, said upper tray 242 is formed by said first tray sub-panel 202 which is folded along the folding line 5 of the lower folding die-cuts 4 of the main panel 2, being said guard flap 206 with free edge 207 additionally folded along the folding line 205. While, said lower tray 243 is formed by said second tray sub-panel 208 which is folded along the folding line 212, being said guard flap 218 additionally folded along the folding line 217.

The display shelving 237 of the present invention has a display front 244 through which the products for sale/display will be placed or withdrawn. Additionally, a roof 245 is defined, formed by said upper roof sub-panel 233 which is folded along the folding line 235 of the folding die-cuts 234. Thus a display shelving unit 237 with a larger number of trays and with a roof is obtained, allowing for a better protection of the articles displayed for sale.

Figure 9A:
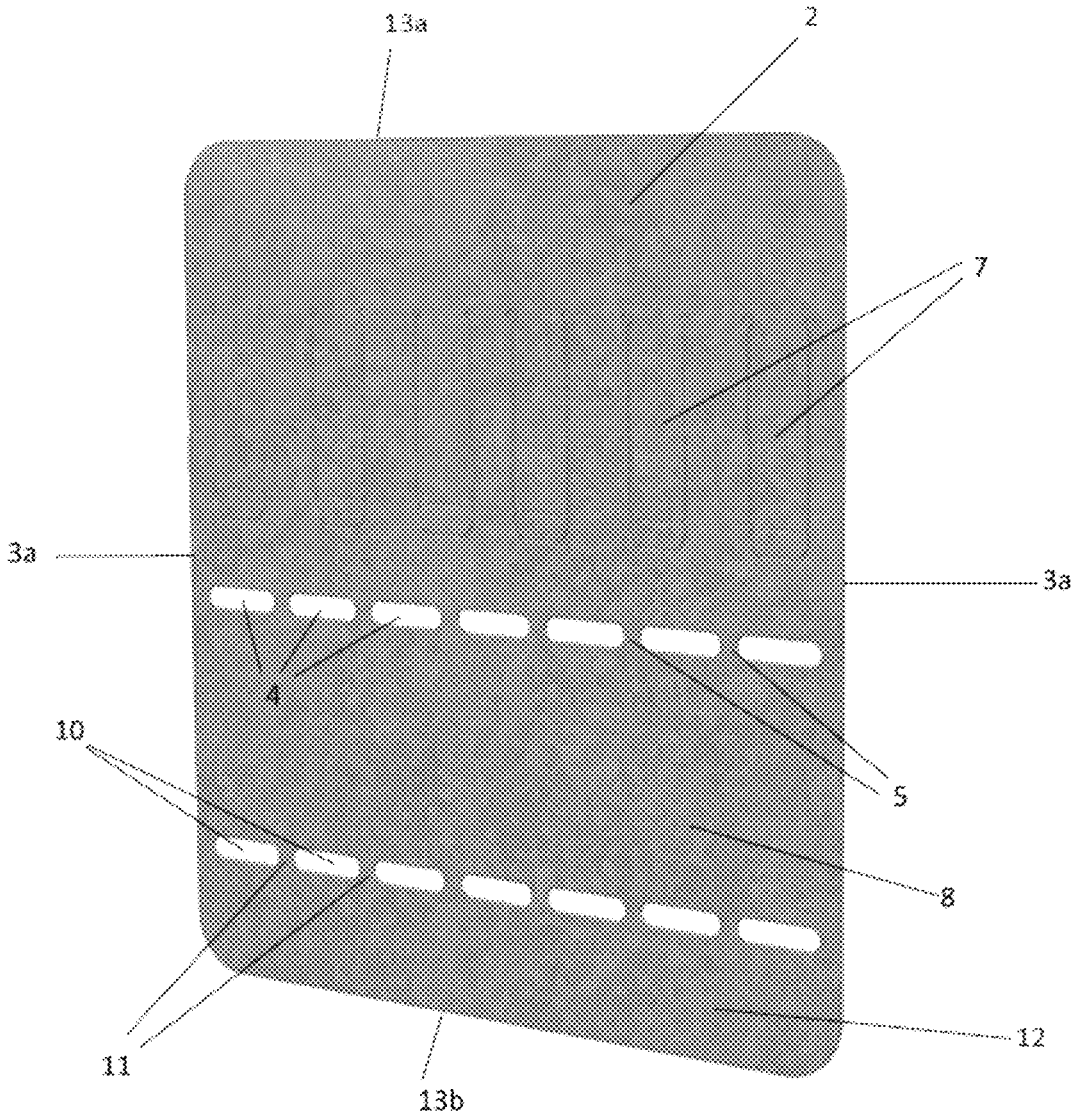
FIG. 9A shows a perspective view of the sheet of the present invention according to a fourth preferred embodiment.
Figure 9B:
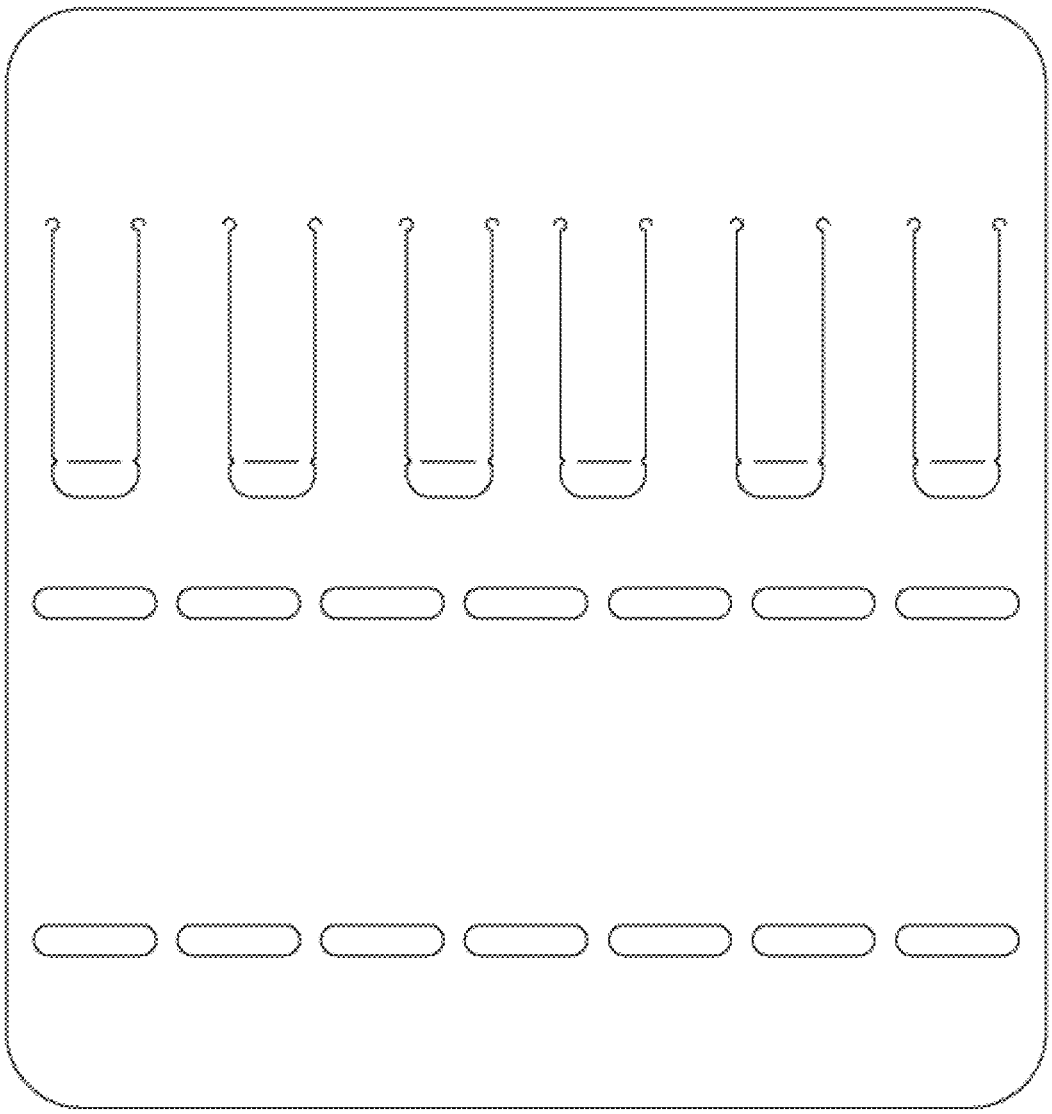
FIG. 9B shows a front view of the sheet of the present invention according to a fourth preferred embodiment.
Figure 10A:
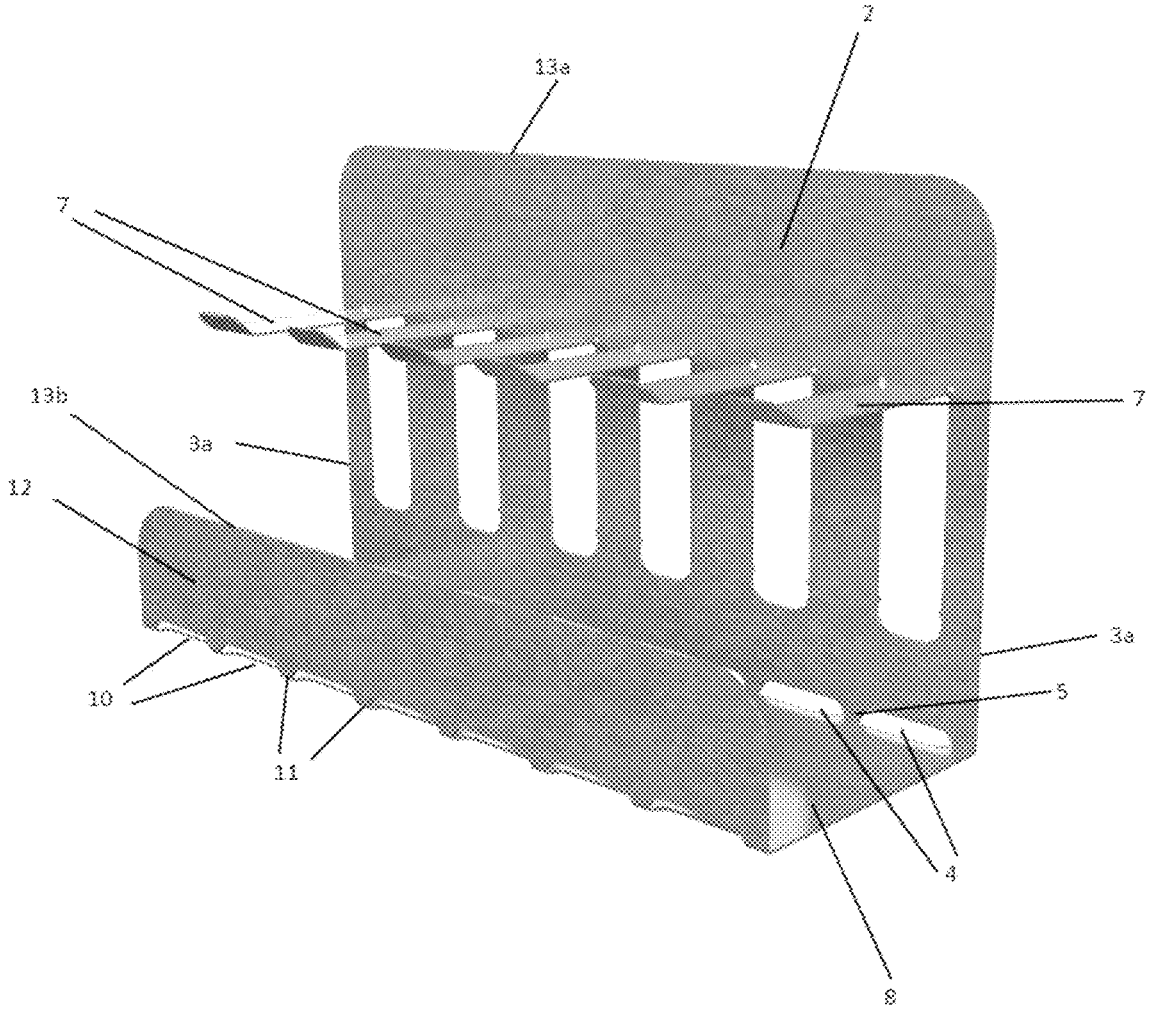
FIGS. 10 (A and B) shows a perspective view of a display shelving unit assembled on the basis of the sheet of FIG. 9.
Figure 10B:
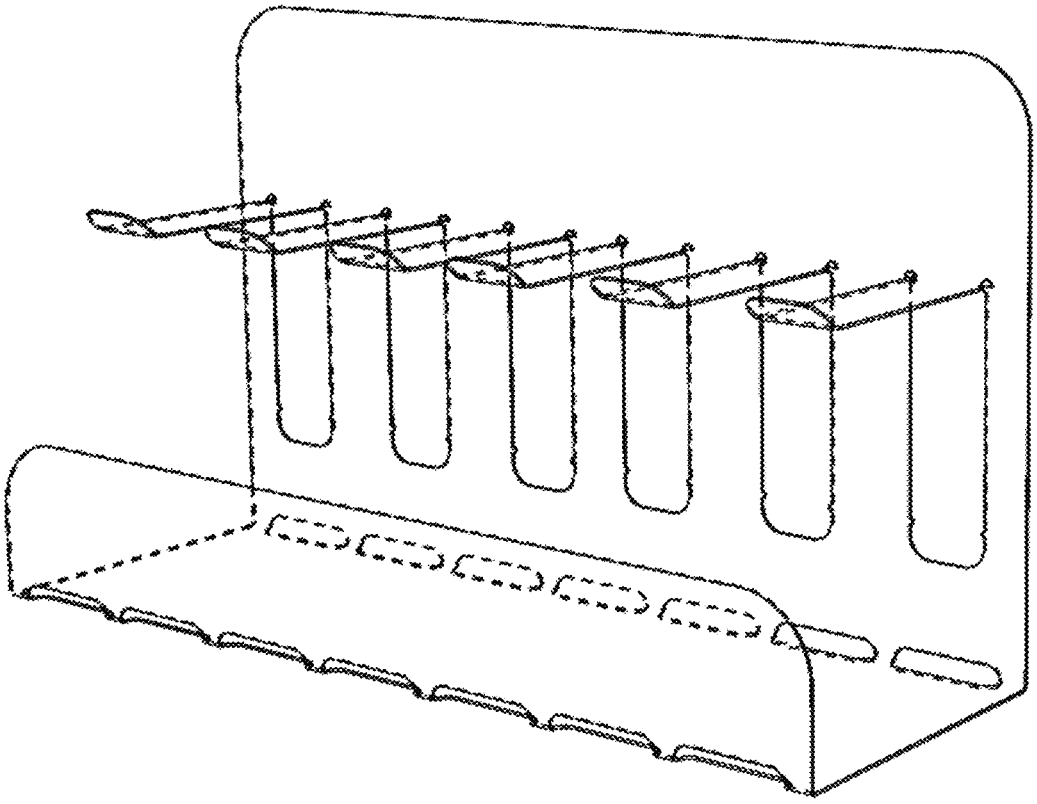

FIGS. 9 and 10 shown another embodiment of the invention, consisting in a simplified version of the embodiment of FIGS. 1 and 4. The embodiment of FIGS. 9 and 10 can be very convenient to prepare displays to be placed on an horizontal surface on top of a piece of furniture, for example the counters in shops of any kind, although they may also be hanged from a wall.

This preferred embodiment is based on the main panel 2 of the sheet of FIG. 1, therefore the same reference numbers will be used to identify the same parts or equivalent parts. In this case, the side edges equivalent to edges 3 of FIG. 1, where the alar side panels 14 are folded, do not have such alar side panels but are free edges referred to with reference number 3*a*, to distinguish them from folding edges 3. The main panel 2 also has a plurality of lower folding die-cuts 4 interconnected along a folding line 5. As in the previous cases, the folding lines, such as line 5 and the others, are virtual or imaginary lines along which the display shelving will be folded upon its assembly.

The main panel 2 has a plurality of foldable die-cut sections 7 which can be folded in order to allow for the hanging of various products, as better illustrated in FIG. 10. One sub-panel 8 is located below the lower folding die-cuts 4 and the folding line 5 and this sub-panel provides a support panel/tray, therefore it can perform the function of a tray, in case the display is hanged from a wall, or simply a support base in case the display is placed on a counter.

Examining the sheet of FIG. 9 downwards, a plurality of lower folding die-cuts 10 interconnected along a folding line 11 are provided, said folding line can also be virtual as in the case of line 5, allowing the folding of at least one guard flap 12 which has a lower free edge 13*b* opposed to an upper free edge 13*a* of the main panel 2. As can be seen in FIG. 10, the flap 12 acts as a retaining wall for the articles placed on the sub-panel 8 when used as a display shelving unit.

Finally, it should be noted that the sheet of the present invention, in any of its embodiments, can be manufactured as a single piece of any metallic material, preferably from any foldable metallic material, for example, steel plate, galvanized steel plate, prepainted steel plate, stainless steel, aluminum, alucobond, or the like, for the final production of display shelving units. Additionally, the folding lines or folding edges and the die-cuts can be performed on said sheet 1 using the traditional methods well known in the art, like die-cutting, stamping, pressure forming, etc.

Although the sheet of the present invention can be obtained through multiple methods and processes, some materials such as aluminum sheet allow for the use of mechanical routers which cut the sheet with a milling cutter, although this is a slow process with rather poor finishing. The sheet can also be punched with a laser router translating a vector file into a sequence of moves of the laser cutter. The sheet can be punched by means of a numerical control punching machine using a variety of tools of different shapes which can perform cuts according to the instructions of a vector file. It can be used together with a laser cutter. The sheet can also be cut using a high pressure water jet, which provides very good finishing and no temperature rise. The sheet can also be stamped by means of dies containing the desired cutting pattern in the mold, which allows for a much faster process.

According to the description hereinabove, a sheet for the assembly of a display shelving unit of the present invention is obtained, which, thanks to its structural simplicity, can be manually assembled and disassembled, in a practical, easy and fast way, which can also be recycled, since it is made of reyclable materials which require lesser production processes, and which, thanks to its reduced volume, allows for the transportation of a larger number of units in the same shipment, thus significantly reducing the related costs.

The invention claimed is:

1. A metallic sheet for an assembly of a display shelving unit for various articles on sale, the metallic sheet comprising:

at least one main panel comprising an upper free edge and a lower free edge and at least a plurality of folding die-cuts aligned along at least two folding lines;

at least one sub-panel of the main panel, arranged between the at least two folding lines and forming a support panel/tray;

one guard flap below one of the at least two folding lines and ending at said lower free edge of the sheet; and one or more alar side panels which are arranged along folding edges in the at least one main panel and can be folded around said at least one main panel;

wherein said at least one sub-panel of the main panel comprises at least one pair of foldable side fixing flaps, where said at least one main panel, at least one sub-panel of the main panel, one or more alar side panels, and guard flap form a single piece of metallic material.

2. A sheet according to claim 1, wherein said at least one main panel has at least one lower base sub-panel comprising at least a plurality of folding die-cuts and one portion with side folding edges around which also such alar side panels are folded.

3. A sheet according to claim 2, wherein said main panel additionally comprises a plurality of secondary support cuts and a plurality of foldable die-cut sections.

4. A sheet according to claim 2, wherein each of such alar side panels has at least one longitudinal side reinforcing member, at least one foldable die-cut reinforcing flap, at least one foldable lower reinforcing flap and at least one perimeter cutout in correspondence with one edge of said foldable side flap for fixing the tray sub-panel.

5. A sheet according to claim 2, wherein the alar side panels have a trapezoidal shape.

6. A display shelving unit formed by means of folding and assembly of the sheet according to claim 2, the display shelving unit comprising:

a bottom portion which is formed by said lower base sub-panel, which is folded along said folding line of its upper folding die-cuts, said foldable guard flap of the lower base sub-panel being additionally folded;

a rear wall formed by said main panel and one portion of said lower base sub-panel;

the display shelving unit further comprising side walls formed by such alar side panels, which are folded along said folding edges of the main panel and the lower base sub-panel; and at least one tray formed by said tray sub-panel which is folded along the folding line of the folding die-cuts of the main panel, being said guard flap with a free edge additionally folded along the folding line of the lower folding die-cuts of the tray sub-panel.

7. A sheet according to claim 1, wherein a plurality of folding die-cuts of a lower base sub-panel comprise upper folding die-cuts and lower folding die-cuts, each of the upper folding and lower folding die-cuts being interconnected along respective folding lines and so that a foldable guard flap is folded along the respective folding line interconnecting the lower folding die-cuts, where additionally, said lower base sub-panel comprises at least one pair of reinforcing foldable flaps.

8. A sheet according to claim 1, wherein the sheet provides at least two sub-panels.

9. A sheet according to claim 1, wherein the sheet provides at least one marquee sub-panel placed on the upper portion of the main panel, said marquee sub-panel comprising at least a plurality of lower folding die-cuts interconnected along a folding line, and at least a plurality of upper folding die-cuts interconnected along a second folding line along which a foldable marquee flap is folded.

10. A sheet according to claim 1, wherein the sheet provides at least one upper roof sub-panel connected to the upper portion of the main panel by means of a plurality of folding die-cuts interconnected along a folding line, where said upper roof sub-panel additionally has at least one pair of reinforcing flaps.

11. A display shelving unit formed by folding and assembly of the sheet according to claim 1, wherein the sheet comprises a bottom portion formed by said at least one main panel, which is folded along one of the at least two folding lines so that said at least one sub-panel of the main panel is arranged horizontally forming the support base/tray, wherein the at least one sub-panel of the main panel is folded along the other of the at least two folding lines so that said guard flap extends upwards and ends at said lower free edge of the sheet.

* * * * *